US006624580B2

(12) United States Patent
Kanegae et al.

(10) Patent No.: US 6,624,580 B2
(45) Date of Patent: Sep. 23, 2003

(54) HIGH PRESSURE ELECTRIC DISCHARGE LAMP

(75) Inventors: Aiko Kanegae, Kanagawa-ken (JP); Masaaki Muto, Kanagawa-ken (JP); Shinya Omori, Kanagawa-ken (JP); Kimihiro Iritono, Kanagawa-ken (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 10/058,974

(22) Filed: Jan. 30, 2002

(65) Prior Publication Data

US 2003/0034738 A1 Feb. 20, 2003

(30) Foreign Application Priority Data

Jan. 31, 2001 (JP) ..... 2001-024471

(51) Int. Cl.[7] ..... H01J 13/46
(52) U.S. Cl. ..... 315/56; 313/26; 313/621
(58) Field of Search ..... 315/57, 56; 313/318.01, 313/25, 318.02, 318.09, 26, 621, 623, 637–643

(56) References Cited

U.S. PATENT DOCUMENTS

| | | | | |
|---|---|---|---|---|
| 5,736,811 A | | 4/1998 | Westemeyer et al. | 313/318.02 |
| 5,757,110 A | * | 5/1998 | Motiduki et al. | 313/25 |
| 6,094,008 A | * | 7/2000 | Omori et al. | 313/634 |
| 6,274,973 B1 | * | 8/2001 | Mochiduki et al. | 313/318.09 |

FOREIGN PATENT DOCUMENTS

| | | |
|---|---|---|
| EP | 0 313 028 A2 | 4/1989 |
| EP | 1 063 681 A2 | 12/2000 |
| JP | 63-190245 | 8/1988 |
| JP | 6-20645 | 1/1994 |

OTHER PUBLICATIONS

EP 02 00 2292 European Search Report, Ex. Vicente May 2,2002 2 pp.

* cited by examiner

*Primary Examiner*—Don Wong
*Assistant Examiner*—Ephrem Alemu
(74) *Attorney, Agent, or Firm*—Morgan, Lewis & Bockius LLP

(57) ABSTRACT

A high pressure electric discharge lamp adapted to utilize dielectric barrier discharges can include an arc tube having a discharge space that contains at least a rare gas and an outer tube airtightly surrounding the arc tube. At least one material selected from Ne, Ar, Kr, Xe, $F_2$, $Cl_2$, $Br_2$, $I_2$ and $N_2$ or a mixture thereof that are apt to produce a dielectric barrier discharge can be filled in the space between the arc tube and the outer tube at pressure preferably between 1.3 and 100 [kPa] and more preferably between 40 and 80 [kPa]. The type and the pressure of the rare gas contained in the space is selected as to make the dielectric barrier discharge starting voltage in the space lower than the discharge starting voltage in the discharge space.

20 Claims, 2 Drawing Sheets

HIGH PRESSURE ELECTRIC DISCHARGE LAMP

This invention claims the benefit of Japanese Patent Application No. 2001-24471, filed on Jan. 31, 2001, which is hereby incorporated by reference.

BACKGROUND OF THE INVENTION

1. Field of the Invention

This invention relates to a high pressure electric discharge lamp with a low starting voltage. Such an electric discharge lamp can find various applications including light sources of vehicles where a high voltage transformed from a battery voltage is applied to the lamp.

2. Description of the Related Art

Generally, high pressure electric discharge lamps including metal halide lamps that are typically used as headlamps of automobiles have a double tube structure formed by enclosing an arc tube that contains mercury, at least one metal halide, and starter gas with an outer tube made of a material absorbing ultraviolet rays.

Japanese Patent Laid-Open Publication No. Hei. 6-20645 discloses an electric discharge lamp having a double tube structure formed by fitting a double-end type arc tube to a base located only at an end thereof. The disclosed discharge lamp is highly vibration resistant and impact resistant by using a straight outer tube that does not surround the current feeding conductors. The current feeding conductors turn back toward the base from the sealing section located opposite to the base in order to make the outer tube surround the arc tube with only a narrow gap separating them. The outer tube does not need to be airtightly sealed and air is found in the space between the outer tube and the arc tube.

Metal halide lamps that are being popularly used as automobile head lamps automobile contain rare gas such as Xe gas as starter gas at about 7 atm to more than 10 atm at room temperature, because they are required to generate an effective flux of light immediately after a start. Thus, in such a lamp, the Xe gas can emit light immediately after a start and a high temperature arc rapidly heats the arc tube to accelerate the evaporation of mercury and metal halide to quickly reach a predetermined amount of luminous flux. Xenon lamps contain xenon gas that also operates as starter gas at about 20 atm in order to quickly reach a predetermined amount of luminous flux.

However, high pressure electric discharge lamps containing starter gas including xenon gas at about 7 atm to more than 10 atm in head lamps of automobiles and at about 20 atm in xenon lamps inevitably require the use of a high drive voltage that is much higher than 10 kV. Therefore, the drive power source of such a lamp is designed to generate a high starting voltage higher than 20 kV. Such a high voltage raises the manufacturing cost of the drive circuit because various components of the arc tube and the harness connected to it are required to show a high degree of dielectric strength. Additionally, noises can be generated at and near the base to give troubles to external facilities. Furthermore, if an electric discharge lamp requires a high starting voltage to energize starter gas for lighting, the voltage necessary for restarting the lamp is inevitably also high.

While efforts have been made to reduce the starting voltage of electric discharge lamps, no effective way of significantly reducing the starting voltage has so far been found.

SUMMARY OF THE INVENTION

In view of the above identified circumstances, it is therefore an object of the present invention to provide a lamp structure and a lighting method that can remarkably reduce the starting voltage of a high pressure electric discharge lamp in order to reduce the cost of the drive unit and alleviate the rigorous requirements for dielectric strength of the various components.

Another object of the present invention is to provide a high pressure electric discharge lamp that is free from fluctuations in the starting voltage that can typically occur as a function of the time consumed for lighting. As the starting voltage of high pressure electric discharge lamps is stabilized, lighting failures and ineffective lighting performances will be reduced to improve the manufacturing yield.

According to an aspect of the invention, in a high pressure electric discharge lamp including an arc tube having a discharge space containing at least a rare gas, a pair of electrodes projecting into the discharge space and arranged oppositely relative to each other, current feeding conductors for feeding the electrodes with an electric current, sealing portions extending from the arc tube and airtightly sealing the current feeding conductors, and an outer tube enclosing the arc tube, the outer tube can be airtightly sealed to the sealing portion, and gas, being apt to produce dielectric barrier discharges, is contained in a space surrounded by the outer tube and the arc tube.

According to another aspect of the invention, the gas apt to produce dielectric barrier discharges can be selected from the group consisting of Ne, Ar, Kr, Xe, $F_2$, $Cl_2$, $Br_2$, $I_2$, $N_2$ and a mixture thereof.

According to another aspect of the invention, a pressure of said gas apt to produce dielectric barrier discharges can be not lower than 1.3 [kPa] and not higher than 100 [kPa].

According to another aspect of the invention a pressure of the gas contained in the space between the outer tube and the arc tube can be not lower than 40 [kPa] and not higher than 80 [kPa].

According to another aspect of the invention, the arc tube can be made of a material containing a dielectric substance. According to another aspect of the invention the discharge space of the arc tube does not contain mercury. According to another aspect of the invention, a method of starting a lighting operation of the high pressure electric discharge lamp is characterized in that the method includes producing a dielectric barrier discharge in the space surrounded by said outer tube and said arc tube by applying an electric field to said space from said current feeding conductors by way of dielectric used for said sealing sections.

According to another aspect of the invention, one of the electrodes projecting into the discharge space of the arc tube can be caused to discharge electrons from the surface thereof, in accordance with incidence of light generated by the dielectric barrier discharge into the surface of the electrode.

According to another aspect of the invention, an electric discharge can be started by inducing an electron avalanche, using the electrons as initial electrons. According to another aspect of the invention, the rated power of the discharge lamp is 35W. According to another aspect of the invention, the discharge space of the arc tube contains at least one metal halide.

According to another aspect of the invention, a method of starting a lighting operation of a high pressure electric discharge lamp is characterized by airtightly sealing an arc tube and an outer tube to form a space between them, producing a dielectric barrier discharge by applying an electric field to said space, and causing electrons generated by said dielectric barrier discharge to be transmitted through the discharge space of said arc tube and starting an electric discharge in said discharge space by the photoelectric effect.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the claimed invention.

DETAILED DESCRIPTION OF THE EMBODIMENTS

Figure 1:
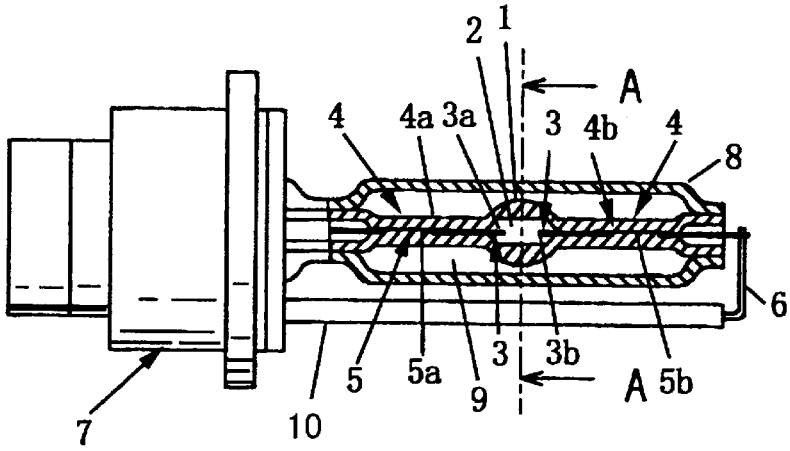
FIG. 1 is a side view of an embodiment of a high-pressure electric discharge lamp according to the invention.
Figure 2:
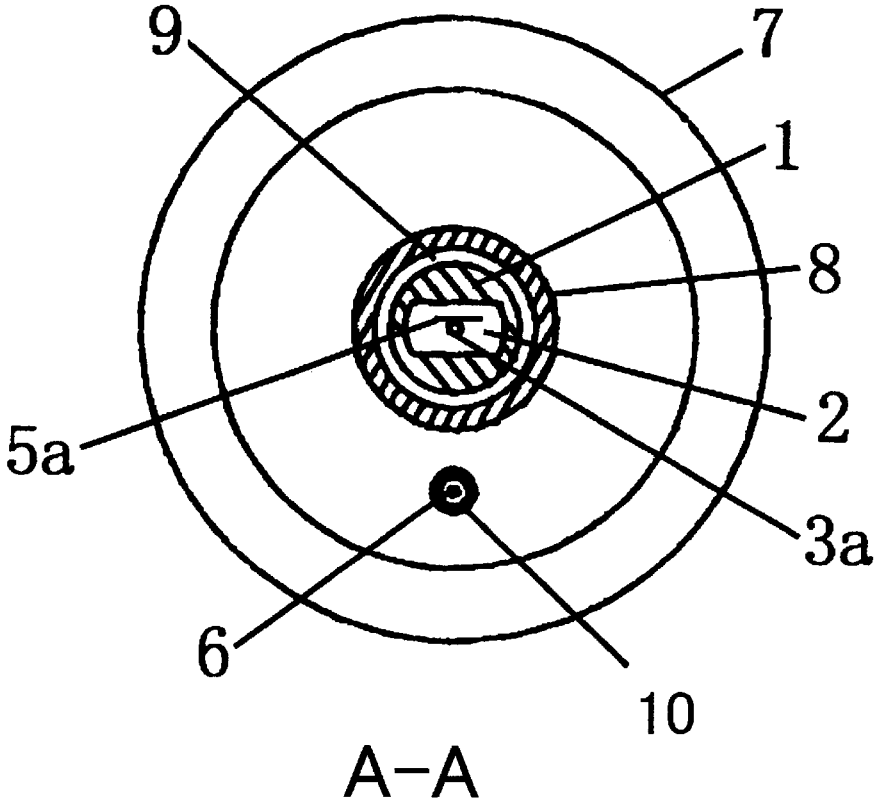
FIG. 2 is an enlarged partial cross sectional view taken along line A—A in FIG. 1.

Preferred embodiments of the invention will now be described with respect to the drawings. FIGS. 1 and 2 schematically illustrate a high pressure electric discharge lamp according to the invention. Note that embodiments of the invention are described below by referring to FIGS. 1 and 2. In FIGS. 1 and 2, there are shown an arc tube 1, an electric discharge space 2 in the arc tube 1, a pair of electrodes 3*a*, 3*b* arranged in the electric discharge space 2, of which one is an anode and the other is a cathode. There are also shown current feeding conductors 5*a*, 5*b* connected respectively to the electrodes 3*a*, 3*b*, sealing sections 4*a*, 4*b* of arc tube 1 for sealing the respective conductors 5*a*, 5*b*, a current feeding conductor 6 connecting the electrode extending from the arc tube 1 and base 7. Thus, the external electrode 6 preferably extends to the base 7 through a ceramic pipe 10. The arc tube 1 can be surrounded by an outer tube 8 with a space 9 separating them. The rated power of the high pressure electric discharge lamp of FIG. 1 is preferably 35W. The electric discharge space 2 can contain at least a rare gas that is xenon gas and at least a metal halide. The volume of the electric discharge space is preferably about 0.026 cc.

At least one gas, apt to produce dielectric barrier discharges, can be selected from the group consisting of Ne, Ar, Kr, Xe, $F_2$, $Cl_2$, $Br_2$, $I_2$, $N_2$ and a mixture thereof, and filled in the space 9 between the arc tube and the outer tube 8.

Now, a process for starting a lighting operation of a high pressure electric discharge lamp according to the invention will be described below.

As a starting pulse is applied between the paired electrodes projecting into the electric discharge space of the arc tube 1 of the high pressure electric discharge lamp, an electric field can also be applied to the space 9 from the current feeding conductors 5*a*, 5*b* buried in the respective sealing portions 4*a*, 4*b* of the arc tube by way of the sealing portions 4*a*, 4*b* which can be made of a dielectric such as quartz glass.

As pointed out above, the space 9 can contain gas that is apt to produce dielectric barrier discharges. If the starting voltage of dielectric barrier discharge is lower than the discharge starting voltage of the arc tube 1, a dielectric barrier discharge starts in the space 9 between the arc tube 1 and the outer tube 8 before an electric discharge starts in the discharge space 2. The starting voltage of dielectric barrier discharge is typically as low as a few kilovolts [kV].

As a dielectric barrier discharge occurs, ultraviolet rays and/or visible light are generated. The wavelength of the ultraviolet rays and/or that of the visible light may differ depending on the type of gas contained in the discharge space. The wavelength of the light that each type of gas produces is known. Table 1 shows the wavelengths of a number of gases.

TABLE 1

| Gas | Wavelength[nm] |
|---|---|
| $Xe_2$* | 172 |
| $Cl_2$* | 259 |
| ArCl* | 175 |
| KrCl* | 222 |
| XeCl* | 308 |

If the contained gas is one selected from Ne, Ar, Kr, Xe, $F_2$, $Cl_2$, $Br_2$, and $I_2$ or a mixture thereof, the produced dielectric barrier discharge is presumably an excimer discharge. In Table 1, the mark "*" denotes that the gas operates as exciton. While the electric discharge mechanism of $N_2$ gas is not known yet, the inventors of the present invention found as a result of an experiment that $N_2$ gas operates like Xe and Ne as a substance capable of producing dielectric barrier discharges.

The arc tube 1 of the high pressure electric discharge lamp is preferably made of a dielectric. If it is made of high quality quartz glass that is typically used for 35W metal halide lamps, the absorption edge of such quartz glass is 170 [nm] at the short wave side. If the wavelength of light generated by the dielectric barrier discharge is greater than this value, light can be transmitted through the wall of the arc tube 1 and get to the surfaces of the electrodes 3*a*, 3*b*. Note that, since the outer tube 8 is typically made of quartz glass that is doped with an ultraviolet ray absorbing substance, no ultraviolet rays having a short wavelength would be emitted to the outside of the high pressure electric discharge lamp.

The paired electrodes 3*a*, 3*b* can be made of tungsten containing thorium oxide and the work function thereof is about 2.5 [eV]. The wavelength of light corresponding to the energy level is calculated to be 496 [nm]. Thus, it is possible for the electrodes to discharge electrons by the photoelectric effect if light shows a wavelength shorter than the above value. However, in reality, the wavelength of light is preferably considerably shorter than the above value because the work function can increase when a light emitting substance adheres to the surface of the electrodes 3*a*, 3*b* and/or the dispersion of thorium oxide is not appropriate. Another reason why light with a shorter wavelength is preferable is that the energy equal to the difference between the energy of photons and the energy corresponding to the work function is provided as kinetic energy of generated electrons.

Since a dielectric barrier discharge is not a self-sustaining discharge, the discharge voltage does not fall after the start of the electric discharge. In other words, it is necessary to keep on applying a voltage of a few kilovolts [kV] between the electrodes of the arc tube 1. If light generated by an external dielectric barrier discharge strikes the electrode 3*a*, or the cathode, to generate electrons (initial electrons), they are accelerated by the electric field to move toward the electrode 3*b*, or the anode. If the number and the kinetic energy of initial electrons are sufficiently large, an electron avalanche occurs to produce a discharge channel in the rare gas contained in the discharge space.

Thus, an electric discharge is started in the arc tube 1 at the discharge starting voltage of dielectric barrier discharge in the space 9 so that the starting voltage of the high pressure electric discharge lamp can be reduced remarkably as compared with comparable conventional electric discharge lamps in which air is found in the space between the arc tube and the outer tube. The restarting voltage is also reduced because an electric discharge is started in the discharge space 2 by way of a dielectric barrier discharge in the space 9.

Known high pressure electric discharge lamps containing metal halide are accompanied by a problem that the starting voltage fluctuates when a lighting operation is repeated and also when the lamp is used repeatedly over a long time period. However, a high pressure electric discharge lamp according to the invention can hold the starting voltage substantially to a constant level because the starting voltage of dielectric barrier discharge does not fluctuate significantly.

A method of starting a lighting operation of a high pressure electric discharge lamp according to the invention is characterized by producing a dielectric barrier discharge in the space 9 between the arc tube 1 and the outer tube 8, by applying an electric field to said space from the current feeding conductors 5*a*, 5*b* buried in the respective sealing portions 4*a*, 4*b* of the arc tube 1 by way of the dielectric of quartz glass or light transmitting ceramic of said sealing portions causing the electrode 3*a*, or the cathode, projecting into the discharge space 2 of said arc tube 1, to discharge electrons from the surface thereof in accordance with incidence of generated light by dielectric barrier discharge in the space 9 into the surface of said electrode 3*a*, and starting an electric discharge by inducing an electron avalanche, using the electrons as initial electrons.

Results of an experiment conducted by using an embodiment of the invention will be described below. A specimen of high pressure electric discharge lamp having a configuration as shown in FIG. 1 was prepared by making the discharge space 2 contain sodium iodide (NaI) and scandium iodide ($ScI_3$) to a ratio by weight of 2:1 and also Xe as starter gas at about 10 atm. The space 9 between the arc tube 1 and the outer tube 8 contained Xe gas at about 10 [kPA]. The rated input electric power of the electric discharge lamp was 35[W].

The starting voltage and the restarting voltage of the electric discharge lamp were observed. Subsequently, a hole was formed in a part of the wall of the outer tube 8 to introduce air into the space 9 between the arc tube 1 and the outer tube 8 and the starting voltage and the restarting voltage were observed again. The restarting voltage was observed by turning off the electric discharge lamp for 10 seconds after a normal lighting state (a state of discharge after initial lighting) and then making the lamp light again. It is known that the voltage for starting an electric discharge is influenced by the rising curve of the starting pulse so that the gradient of the rising edge of the pulse (N. B.: the rising rate of the starting pulse voltage) was held to a constant value of 15 [kV/s] for the experiment. For each specimen in the following tables, the starting voltage and the restarting voltage were observed by the same method described above. Each specimen in the same table has the same structure.

Table 2(*a*) below shows the result of observing the starting voltage when the discharge space 2 did not contain mercury, whereas Table 2(*b*) below shows the result of observing the restarting voltage.

TABLE 2(a)

Hg-free, Xe gas, Starting Voltage

| | Voltage[kV] Space 9 | |
|---|---|---|
| Specimen No. | Xe | Air |
| 1 | 4 | 14 |
| 2 | 5 | 15 |
| 3 | 4 | 12 |
| 4 | 5 | 18 |
| 5 | 6 | 19 |

TABLE 2(b)

Hg-free, Xe gas, Restarting Voltage

| | Voltage[kV] Space 9 | |
|---|---|---|
| Specimen No. | Xe | Air |
| 1 | 6 | 7 |
| 2 | 7 | 6 |
| 3 | 8 | 9 |
| 4 | 6 | 6 |
| 5 | 7 | 8 |

When the space 9 between the arc tube 1 and the outer tube 8 was made to contain Xe gas, both the starting voltage and the restarting voltage fell from the respective levels obtained when the space 9 contained air.

Another specimen was prepared. This specimen was identical to the first one except that the 9 between the arc tube 1 and the outer tube 8 was made to contain $N_2$ gas at about 79 [kPa] and a similar experiment was conducted by using this specimen. Tables 3(*a*) and 3(*b*) show respectively the result of observing the starting voltage and that of observing the restarting voltage when the discharge space 2 did not contain mercury.

TABLE 3(a)

Hg-free, N2 gas, Starting Voltage

| | Voltage[kV] Space 9 | |
|---|---|---|
| Specimen No. | $N_2$ | Air |
| 1 | 9 | 16 |
| 2 | 8 | 13 |
| 3 | 8 | 15 |
| 4 | 10 | 20 |
| 5 | 8 | 18 |

TABLE 3(b)

Hg-free, N2 gas, Restarting Voltage

| | Voltage[kV] Space 9 | |
|---|---|---|
| Specimen No. | $N_2$ | Air |
| 1 | 7 | 7 |
| 2 | 7 | 9 |
| 3 | 8 | 8 |
| 4 | 7 | 8 |

TABLE 3(b)-continued

| Hg-free, N2 gas, Restarting Voltage | | |
|---|---|---|
| | Voltage[kV] Space 9 | |
| Specimen No. | $N_2$ | Air |
| 5 | 7 | 7 |

A specimen wherein the space 9 between the arc tube 1 and the outer tube 8 contained $N_2$ gas was sufficiently effective for reducing the starting voltage, although not as effective as a specimen containing Xe gas. It was also confirmed that the specimen containing $N_2$ gas in the space 9 tends to have lower restarting voltage than the one containing air in the space 9.

Still another specimen was prepared. This specimen was identical to the first one except that the space 9 between the arc tube 1 and the outer tube 8 was made to contain a mixture gas of Xe/Ne at about 2:8 in pressure ratio totaling 79 [kPa] and a similar experiment was conducted by using this specimen. Tables 4(*a*) and 4(*b*) show respectively the result of observing the starting voltage and that of observing the restarting voltage when the discharge space 2 did not contain mercury.

TABLE 4(a)

| Hg-free, Xe/Ne gas, Starting Voltage | | |
|---|---|---|
| | Voltage[kV] Space 9 | |
| Specimen No. | Xe/Ne | Air |
| 1 | 5 | 16 |
| 2 | 5 | 15 |
| 3 | 5 | 18 |
| 4 | 6 | 12 |
| 5 | 5 | 13 |

TABLE 4(b)

| Hg-free, Xe/Ne gas, Restarting Voltage | | |
|---|---|---|
| | Voltage[kV] Space 9 | |
| Specimen No. | Xe/Ne | Air |
| 1 | 7 | 7 |
| 2 | 7 | 8 |
| 3 | 7 | 7 |
| 4 | 7 | 6 |
| 5 | 6 | 8 |

A further specimen was prepared. This specimen was identical to the corresponding one of those used for the Tables 2(*a*) to 4(*b*) except that the arc tube 1 additionally contained mercury. Table 5(*a*) through 5(*f*) shows some of the observed results.

TABLE 5(a)

| Hg-contained, Xe gas, Starting Voltage | | |
|---|---|---|
| | Voltage[kV] Space 9 | |
| Specimen No. | Xe | Air |
| 1 | 6 | 11 |
| 2 | 6 | 10 |
| 3 | 6 | 13 |
| 4 | 6 | 12 |
| 5 | 6 | 11 |

TABLE 5(b)

| Hg-contained, Xe gas, Restarting Voltage | | |
|---|---|---|
| | Voltage [kV] Space 9 | |
| Specimen No. | Xe | Air |
| 1 | 6 | 12 |
| 2 | 7 | 13 |
| 3 | 6 | 15 |
| 4 | 8 | 12 |
| 5 | 9 | 16 |

TABLE 5(c)

| Hg-contained, N2 gas, Starting Voltage | | |
|---|---|---|
| | Voltage[kV] Space 9 | |
| Specimen No. | $N_2$ | Air |
| 1 | 7 | 10 |
| 2 | 7 | 9 |
| 3 | 7 | 10 |
| 4 | 11 | 12 |
| 5 | 10 | 11 |

TABLE 5(d)

| Hg-contained, N2 gas, Restarting Voltage | | |
|---|---|---|
| | Voltage[kV] Space 9 | |
| Specimen No. | $N_2$ | Air |
| 1 | 11 | 11 |
| 2 | 11 | 12 |
| 3 | 11 | 12 |
| 4 | 12 | 13 |
| 5 | 10 | 11 |

TABLE 5(e)

| Hg-contained, Xe/Ne gas, Starting Voltage | | |
|---|---|---|
| | Voltage[kV] Space 9 | |
| Specimen No. | Xe/Ne | Air |
| 1 | 6 | 9 |
| 2 | 6 | 10 |
| 3 | 5 | 10 |

TABLE 5(e)-continued

| Hg-contained, Xe/Ne gas, Starting Voltage | | |
|---|---|---|
| | Voltage[kV] Space 9 | |
| Specimen No. | Xe/Ne | Air |
| 4 | 5 | 11 |
| 5 | 5 | 13 |

TABLE 5(f)

| Hg-contained, Xe/Ne gas, Restarting Voltage | | |
|---|---|---|
| | Voltage[kV] Space 9 | |
| Specimen No. | Xe/Ne | Air |
| 1 | 11 | 11 |
| 2 | 11 | 12 |
| 3 | 11 | 13 |
| 4 | 11 | 11 |
| 5 | 11 | 13 |

A specimen containing mercury wherein the space 9 between the arc tube 1 and the outer tube 8 was made to contain Xe gas showed a reduced restarting voltage as compared with the specimen where the space 9 contained air.

All the specimens of discharge lamp wherein the discharge space 2 did not contain mercury as listed in Tables 2(*a*) through 4(*b*) showed a reduced restarting voltage between about 6 and 8 [kV] regardless of the type of gas contained in the space 9 between the arc tube 1 and the outer tube 8. However, in comparison with the re-starting voltage of the discharge lamp containing mercury in the discharge space 2, the reduction effect of the re-starting voltage of the mercury-free discharge lamp is small. It is considered that, since mercury which exits at high pressure just after turn-off of the mercury-containing discharge lamp does not exist in the discharge space 2 in the mercury-free discharge lamp, the electrons existing in the discharge space 2 greatly affect on re-starting voltage of the discharge lamp on its re-start. Electrons remain in the discharge space 2 just after turn-off of the discharge lamp. Such electrons act as initial electrons on re-start of the discharge lamp. On re-start of the discharge lamp, it is possible that such electrons exist in the discharge space 2 at substantially the same amount as the amount of initial electrons that are to be incident to one of the electrodes 3*a* and 3*b* by way of dielectric barrier discharge in the space 9

Figure 3:
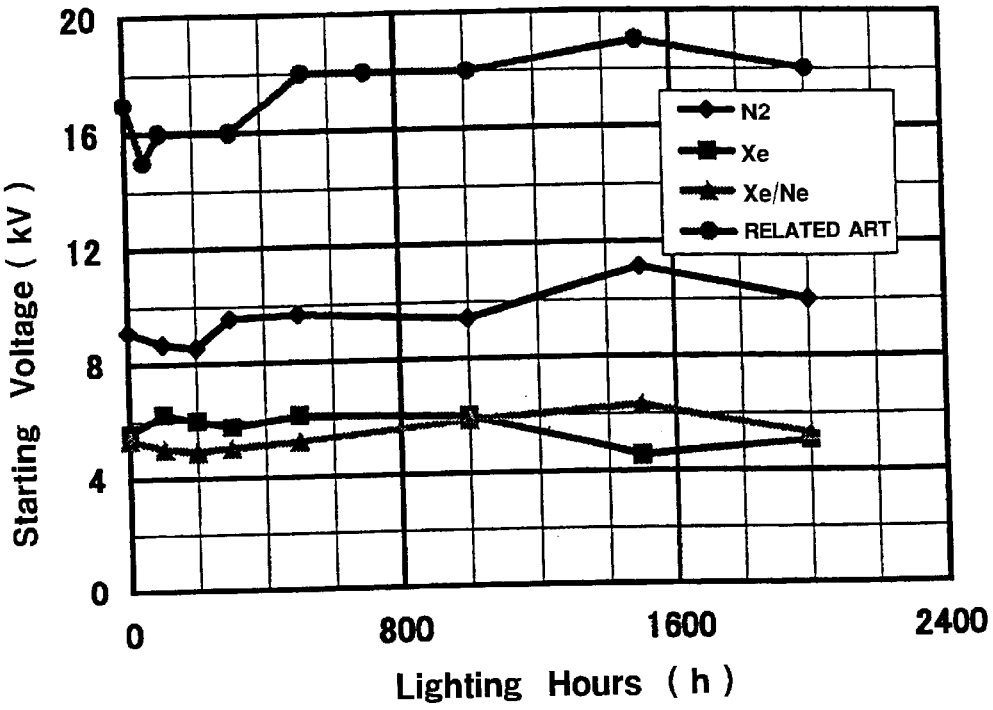
FIG. 3 is a graph illustrating the change with time of the starting voltage obtained by using different types of gas for the gas contained in the space between the outer tube and the arc tube of a high pressure electric discharge lamp according to the invention.

The specimens of discharge lamp of Table 5(*a*) through 5(*f*) showed a remarkably reduced starting voltage, similar to that of the specimens listed in Tables 2(*a*) through 4(*b*) and containing no mercury. Thus, an electric discharge lamp wherein the space 9 between the arc tube 1 and the outer tube 8 contains at least one material selected from Ne, Ar, Kr, Xe, $F_2$, $Cl_2$, $Br_2$, $I_2$ and $N_2$ or a mixture thereof that are known to be apt to produce a dielectric barrier discharge also shows an effect of reducing the starting voltage and the restarting voltage of the arc tube 1 regardless if the discharge space 2 contains mercury or not just as in the case of a discharge lamp in which the space 9 contains Xe or $N_2$. It will be appreciated that a dielectric barrier discharge requires only a short period of time (less than 1 mSec.) from the start of the discharge in the space 9 to the start of an electric discharge in the discharge space 2, therefore no delay that can give rise to a problem occurs on the start of an electric discharge in the discharge space 2. With a method of starting a lighting operation of a high pressure electric discharge lamp using a dielectric barrier discharge according to the invention, it is possible to reduce the change with time of the starting voltage. FIG. 3 is a graph illustrating the change with time of the starting voltage obtained by using different types of gas including Xe, $N_2$ and Xe/Ne for the gas contained in the space between the outer tube and the arc tube of a high pressure electric discharge lamp as shown in FIG. 1.

Thus, if compared with known electric discharge lamps in which the space between the arc tube and outer tube contains air, a high pressure electric discharge lamp that contains gas apt to produce a dielectric barrier discharge in space 9 can keep its starting voltage in a rather smaller predetermined range even though lighting hours increase.

The pressure of the gas contained in the space 9 between the arc tube 1 and the outer tube 8 may be selected appropriately so as to cause the space 9 to produce dielectric barrier discharges efficiently and make the dielectric barrier discharge starting voltage lower than the discharge starting voltage in the discharge space 2. It is acceptable to set the pressure of the contained gas in a range between about 1.3 [kPa] and about 100 [kPa] because a dielectric barrier discharge can be efficiently produced with such a gas pressure level. It is known that a dielectric barrier discharge shows a poor light emitting efficiency when the gas pressure is not higher than 1.3 [kPa]. On the other hand, it is difficult to seal the outer tube 8 and the sealing sections 4*a*, 4*b* if the pressure of the contained gas is not lower than 100 [kPa] because no negative pressure is there. The type of gas and the gas pressure in the space 9 can be optimally selected by considering the temperature balance and the light emitting efficiency of the arc tube.

According to the experiments conducted by the inventors of the present invention, the pressure of the gas contained in the space 9 is preferably in the range being not lower than 40 [kPa] and not higher than 80 [kPa]. If the gas pressure in the space 9 is lower than 40 [kPa], the discharge lamp tends to have short lifetime. Since heat transmission by the gas decreases, the arc tube 1 has an excessively high temperature, resulting in promotion of chemical reactions. If the gas pressure in the space 9 is not higher than 80 [kPa], it is easy to seal the sealing sections 4*a*, 4*b* and the outer tube 8 with a normal sealing method.

As for the pressure of the rare gas contained in the discharge space 2 of the arc tube 1 when xenon gas is selected for the rare gas, it is difficult to obtain an effect of sufficiently reducing the starting voltage when the Xe gas pressure in the discharge space 2 is less than 3 atm because the starting voltage of the arc tube is substantially equal to the dielectric barrier discharge starting voltage.

As described above, a high pressure electric discharge lamp can be obtained by utilizing dielectric barrier discharges because an arc discharge can be produced in the arc tube 1 by applying a low voltage. Additionally, the discharge stability and other characteristics of the electric discharge lamp can be controlled easily and satisfactorily because the starting voltage can be held low.

Effects similar to those described above can be obtained when the arc tube 1 is made of a dielectric such as light transmitting ceramic. The present invention is applicable to various high pressure electric discharge lamps that include an arc tube that contains rare gas. Such high pressure electric discharge lamps include high pressure xenon discharge lamps and high pressure metal halide discharge lamps.

As described above, according to the invention, it is possible to remarkably reduce the starting voltage of a high pressure electric discharge lamp containing rare gas. As a result, the cost of the drive unit of the lamp can be reduced. Additionally, the dielectric strength of the base and the harness of the lamp can also be reduced to further reduce the cost. Still additionally, noises that can be generated at and near the base when applying a high voltage at the start of a lighting operation are also reduced to avoid adverse effect to external facilities.

On the other hand, a high pressure electric discharge lamp according to the invention can obviate fluctuations in the starting voltage and prevent problems associated with lighting failures. As the starting voltage of high pressure electric discharge lamps is stabilized, lighting failures and ineffective lighting performances will be reduced to improve the manufacturing yield.

It will be apparent to those skilled in the art that various changes and modifications can be made herein without departing from the spirit and scope of the invention. Thus, it is intended that the invention cover the modifications and variations of this invention provided they come within the scope of the appended claims and their equivalents.

What is claimed:

1. A high pressure electric discharge lamp, comprising:

an arc tube having a discharge space containing at least a rare gas;

a pair of electrodes projecting into said discharge space and arranged oppositely relative to each other;

current feeding conductors for feeding said electrodes with an electric current;

sealing sections extending from said arc tube and sealing said current feeding conductors;

an outer tube sealed to said sealing sections and enclosing said arc tube; and gas contained in a space surrounded by said outer tube, said gas being apt to produce dielectric barrier discharges having a starting voltage lower than a discharge starting voltage of the arc tube so that a starting voltage of the lamp is reduced.

2. The discharge lamp according to claim 1, wherein said gas apt to produce dielectric barrier discharges is one selected from the group consisting of Ne, Ar, Kr, Xe, $F_2$, $Cl_2$, $Br_2$, $I_2$, $N_2$ and a mixture thereof.

3. A high pressure electric discharge lamp, comprising:

an arc tube having a discharge space containing at least a rare gas;

a pair of electrodes projecting into said discharge space and arranged oppositely relative to each other;

current feeding conductors for feeding said electrodes with an electric current;

sealing sections extending from said arc tube and sealing said current feeding conductors;

an outer tube sealed to said sealing sections and enclosing said arc tube; and gas contained in a space surrounded by said outer tube, said gas being apt to produce dielectric barrier discharges, wherein said gas apt to produce dielectric barrier discharges is one selected from the group consisting of Ne, Ar, Kr, Xe, $F_2$, $Cl_2$, $Br_2$, $I_2$, $N_2$ and a mixture thereof, and wherein a pressure of said gas apt to produce dielectric barrier discharges is not lower than 1.3[kPa] and not higher than 100 [kPa].

4. A high pressure electric discharge lamp, comprising:

an arc tube having a discharge space containing at least a rare gas;

a pair of electrodes projecting into said discharge space and arranged oppositely relative to each other;

current feeding conductors for feeding said electrodes with an electric current;

sealing sections extending from said arc tube and sealing said current feeding conductors;

an outer tube sealed to said sealing sections and enclosing said arc tube; and gas contained in a space surrounded by said outer tube, said gas being apt to produce dielectric barrier discharges, wherein a pressure of the gas contained in the space surrounded by said outer tube is not lower than 40[kPa] and not higher than 80[kPa].

5. The discharge lamp according to claim 1, wherein said arc tube is made of a material containing a dielectric substance.

6. The discharge lamp according to claim 5, wherein a rated power of the lamp is 35 W.

7. The discharge lamp according to claim 1, wherein said discharge space of the arc tube is mercury-free.

8. The discharge lamp according to claim 1, wherein a rated power of the lamp is 35 W.

9. The discharge lamp according to claim 1, wherein said discharge space of said arc tube contains at least one metal halide.

10. The discharge lamp according to claim 1, wherein the outer tube is airtightly sealed with the sealing section and the sealing section is airtightly sealed to the current feeding conductors.

11. A method of starting a lighting operation of a high pressure electric discharge lamp that includes an arc tube having a discharge space containing at least a rare gas, a pair of electrodes projecting into said discharge space and arranged oppositely relative to each other, current feeding conductors for feeding said electrodes with an electric current, sealing sections extending from said arc tube and sealing said current feeding conductors, an outer tube sealed to said sealing sections and enclosing said arc tube, and gas contained in a space surrounded by said outer tube, said gas being apt to produce dielectric barrier discharges having a starting voltage lower than a discharge starting voltage of the arc tube so that a starting voltage of the lamp is reduced, comprising:

producing a dielectric barrier discharge in the space surrounded by said outer tube of said arc tube by applying an electric field to said space from said current feeding conductors by way of dielectric used for said sealing sections.

12. The method according to claim 11, further comprising:

causing one of the electrodes projecting into the discharge space of said arc tube to discharge electrons from the surface thereof in accordance with incidence of light generated by said dielectric barrier discharge to the surface of said electrode.

13. The method according to claim 11, further comprising:

starting an electric discharge by inducing an electron avalanche, using said electrons as initial electrons.

14. A method of starting a lighting operation of a high pressure electric discharge lamp, comprising:

sealing an arc tube and an outer tube to form a space between them;

producing a dielectric barrier discharge by applying an electric field to said space; and causing electrons generated by said dielectric barrier discharge to be transmitted through a discharge space of said arc tube and starting an electric discharge in said discharge space by photoelectric effect.

15. The method of claim 14, wherein the step of sealing includes airtightly sealing.

16. A high pressure electric discharge lamp, comprising:

an arc tube having sealing sections and a discharge space containing a rare gas;

a pair of electrodes projecting into said discharge space;

current feeding conductors each located in a respective one of said sealing sections for feeding said electrodes with an electric current;

an outer tube sealed to said arc tube; and gas contained in a space enclosed by said outer tube, said gas being apt to produce dielectric barrier discharges having a starting voltage lower than a discharge starting voltage of the arc tube so that a starting voltage of the lamp is reduced.

17. The discharge lamp according to claim 16, wherein said gas apt to produce dielectric barrier discharges is one selected from the group consisting of Ne, Ar, Kr, Xe, $F_2$, $Cl_2$, $Br_2$, $I_2$, $N_2$ and a mixture thereof.

18. A high pressure electric discharge lamp, comprising:

an arc tube having sealing sections and a discharge space containing a rare gas;

a pair of electrodes projecting into said discharge space;

current feeding conductors each located in a respective one of said sealing sections for feeding said electrodes with an electric current;

an outer tube sealed to said arc tube; and gas contained in a space enclosed by said outer tube, said gas being apt to produce dielectric barrier discharges, wherein a pressure of said gas apt to produce dielectric barrier discharges is not lower than approximately 1.3[kPa] and not higher than approximately 100[kPa].

19. A high pressure electric discharge lamp, comprising:

an arc tube having sealing sectins and a discharge space containing a rare gas;

a pair of electrodes projecting into said discharge space;

current feeding conductors each located in a respective one of said sealing sections for feeding said electrodes with an electric current;

an outer tube sealed to said arc tube; and gas contained in a space enclosed by said outer tube, said gas being apt to produce dielectric barrier discharges, wherein a pressure of the gas contained in the space between said outer tube and said arc tube is not lower than a approximately 40[kPa] and not higher than a approximately 80[kPa].

20. The discharge lamp according to claim 16, wherein said arc tube is made of a material containing a dielectric substance.

* * * * *